United States Patent [19]

Szkalak

[11] 4,390,179

[45] Jun. 28, 1983

[54] MULTI-STATION EXERCISING APPARATUS

[76] Inventor: Kalman Z. Szkalak, 7631 Yukon Dr., Huntington Beach, Calif. 92648

[21] Appl. No.: 279,530

[22] Filed: Jul. 1, 1981

[51] Int. Cl.[3] ..... A63B 21/06

[52] U.S. Cl. ..... 272/118; 272/134

[58] Field of Search ..... 272/118, 93, 117, 134, 272/144

[56] References Cited

U.S. PATENT DOCUMENTS 3,850,431 11/1974 Winans ..... 272/118

4,231,568 11/1980 Riley et al. ..... 272/134 X

OTHER PUBLICATIONS

"Sevens Stations"–Marcy's Catalogue, 1974, p. 11.

*Primary Examiner*—Richard C. Pinkham

*Assistant Examiner*—William R. Browne

*Attorney, Agent, or Firm*—Klein & Szekeres

[57] ABSTRACT

Exercising apparatus includes a structural framework having a number of positions for the stationing of different types of exercising machines. Each of the machines is of the type which employs a pulley system to lift a variable weight. All of the pulley systems share a common central pulley which is pivotally attached to the framework. A single rope or cable is attached to the variable weight, passes through the central pulley, and is removably attachable to the appropriate component of each of the exercise machines. The pivoting central pulley thus allows the weight to be selectively attached to the desired machine by means of the cable.

12 Claims, 2 Drawing Figures

MULTI-STATION EXERCISING APPARATUS

BACKGROUND OF THE INVENTION

This invention relates generally to the field of exercising equipment, and in particular, it relates to exercising equipment of the type employing a pulley system through which a person lifts a variable weight.

Exercising machines, of the type employing a pulley system to lift a fixed or a variable weight, are well known in the art. Typically, such machines include a mechanism which a person must actuate in opposition to the gravitational pull on the weight in order to develop a particular muscle or group of muscles. Usually, a different mechanism is used to develop each of the different muscles or muscle groups in the body. Accordingly, the common practice is to employ a separate machine for each of the different parts of the body, such as, for example, the arms, the legs, the chest, and the shoulders. Thus, a person who is interested in developing or exercising more than one or two parts of the body must employ several different exercising machines. The use of several different machines is not only costly (due to, for example, the duplication of many components, particularly the weights), but also there is a relatively large floor space requirement, and both of these factors have made it impractical, for the most part, to install such equipment in an individual's home. Thus, use of such equipment usually requires the inconvenience of travelling to a public or private gymnasium or the like, in which such equipment is installed.

It can therefore be seen that there would be great benefit from a device which would provide the functions of several different exercising machines using a relatively small amount of floor space, and which would eliminate or minimize the duplication of like or similar components so as to minimize the cost of such apparatus.

SUMMARY OF THE INVENTION

Broadly, the present invention comprises a multi-station exercising apparatus in which a plurality of pulley-actuated weight lifting machines share a common support structure, central pulley, and weight system. A rope or cable is attached to the weight or weights, and passes through the central pulley and through a fixed pulley mechanism associated with each machine to a component on the individual machine to which the rope or cable is removably attached. The common central pulley is pivotally mounted so that the rope or cable can be detached from one machine and, through the rotation of the central pulley, be brought into a position to be reattached to another machine through the second machine's associated pulley system.

More specifically, the invention comprises a structural support framework having a plurality of discrete stations adapted for the attachment of an individual exercising machine, along with the machine's associated pulley mechanism. Pivotally mounted on the framework at a central location is the common central pulley, adapted for rotation so as to bring the rope or cable into position for attachment to the selected machine. The other end of the cable is attached to a device which is loaded with the desired weight for use with the selected exercise machine.

As will be further made clear in the detailed description which follows, the above-described arrangement allows the use of multiple exercise machines in a relatively small amount of floor area. Moreover, it can be seen that by use of the single central pulley, cable, and weighting mechanism, duplication of components is minimized, thereby achieving significant economies in manufacture.

DETAILED DESCRIPTION OF THE INVENTION

Figure 1:
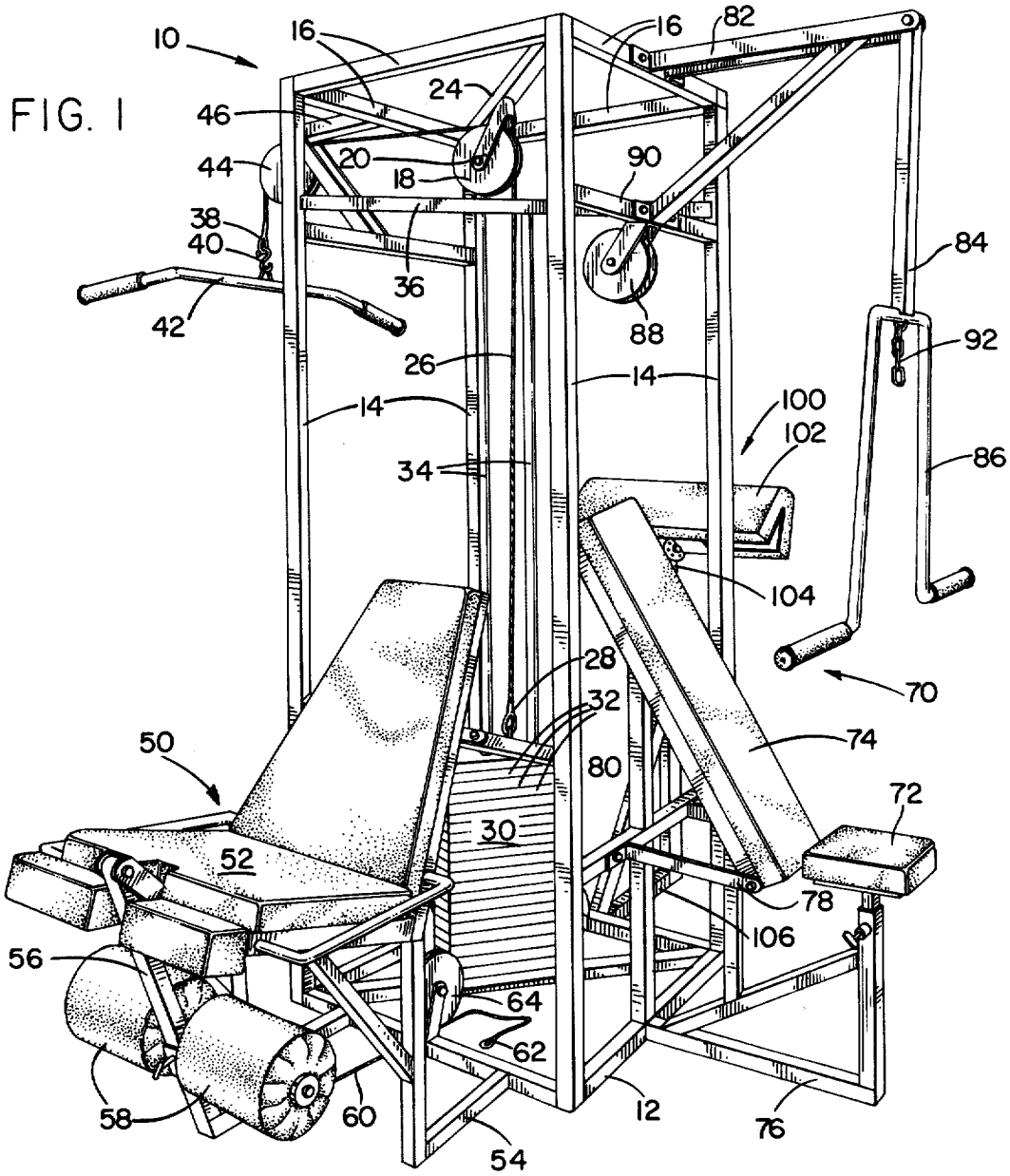
FIG. 1 is a perspective view of a multi-station exercise apparatus, constructed in accordance with the present invention, showing such apparatus in conjunction with several different types of exercising machines.

Referring to the drawings, a multi-station exercising apparatus, in accordance with the present invention, includes a structural support framework 10, comprising a generally square base 12, from the corners of which extend four upright supports 14, joined at the top by four horizontal top members 16.

The framework members 12, 14 and 16 thus define a four sided structure, with each of the sides providing, as will soon be shown, a station for an individual exercising machine. While a structure which provides four stations is deemed to be the preferred embodiment, it will be readily appreciated that the structure described above can be readily modified to provide as few as three stations, or any reasonable number of stations above the four described herein.

A central pulley 18 is rotatably mounted in a pulley bracket 20, which, in turn, is pivotally attached, as by a pin or bushing 22 (FIG. 2), to a diagonal horizontal member 24 which traverses the vertical axis of the structural framework 10, at or near the top thereof. It is preferable to mount the pulley bracket 20 near the center of the diagonal member 24, so that the pin or bushing 22 is substantially coaxial with the vertical axis of the framework 10.

A rope or cable 26 has one end attached, as by a loop 28, to a variable weight stack 30, comprising a plurality of vertically stacked metal plates 32. The variable weight stack 30 is conventional in design and includes means (not shown) for selecting the number of plates 32 which are lifted by means of the cable 26 along a pair of parallel vertical guide bars 34, thereby allowing a person to select varying weights with which to perform the exercises. The upper ends of the guide bars 34 terminate in an upper diagonal horizontal support member 36 situated within the structural framework beneath the central pulley 18, while the lower ends of the guide bars 34 are seated in a lower support member 37 diagonally traversing the base 12.

The end of the rope or cable 26 opposite the loop 28 likewise terminates in a loop 38, to which is attached one end of an "S"-hook 40, adapted for removable attachment to an appropriate component on each of the exercise machines used in conjunction with the apparatus, as further described below.

As shown in the drawing, the apparatus of the present invention is adapted for the attachment of an exercise machine at each of the sides or stations of the framework 10. The machines used in conjunction with the apparatus are of the conventional weight-and-pulley-actuated type, and the selection of the particular machines may be varied to suit the individual needs of each user. For the purposes of completeness of the present disclosure, it may be helpful to describe briefly several machines which may be used.

As shown in FIG. 1, the rope or cable 26 (which has been passed through the central pulley 18) is attached, via the "S"-hook 40, to a lateral pull-down bar 42. The pull-down bar 42 operates through a fixed pull-down bar pulley 44, which is suspended from a boom 46 attached to the framework 10 near the top thereof. Thus, a person may pull down on the bar 42 to lift the weight stack 30 by means of the cable 26 and the pulleys 44 and 18, about which the rope or cable 26 has been wrapped. At the same station may be provided a bottom pulley 48 (FIG. 2) under which the rope or cable 26 may be passed prior to attachment to the bar 42, thereby allowing the weight 30 to be lifted by an upward pull on the bar 42.

Another machine which may be used in conjunction with the apparatus of the present invention is a leg exercising machine 50 comprising a seat 52 which has a base 54 attached to the base 12 of the framework 10, either permanently as by welding, or removably as by bolts (not shown). Extending in front of the seat 52 is a pivoting arm 56, on opposite sides of which is attached a pair of cylindrical pads 58. Attached to the bottom of the arm 56 is a rope or cable 60 terminating in a loop 62. The rope or cable 60 is passed through a fixed leg exercise machine pulley 64 which is mounted on the base 12 of the framework 10.

When it is desired to use the leg exercise machine 50, the "S"-hook 40 is detached from the pull-up bar 42 and the rope or cable 26 is removed from the pull-up bar pulley 44. The bracket 20 of the central pulley 18 is pivoted about the pin 22 so that the pulley 18 is in a position suitable for the operation of the leg exercising machine 50. The "S"-hook is then attached to the loop 62 of the leg exercise machine cable 60. The user can then lift the weight stack 30 by the exertion of leg pressure against the pads 58, causing the pivoting arm 56 to pull the cable 60 through the pulleys 64 and 18.

A third exercise machine which may be used in conjunction with the apparatus of the invention is a bench press machine 70. The bench press machine 70 advantageously includes a height-adjustable stool 72 and an inclined back support 74, which may advantageously be adapted to vary the angle of incline. The stool 72 and the back support 74 are attached to the framework 10 by means of a base pedestal 76 and outwardly extending support arms 78, respectively. The base pedestal 76 is advantageously attached to the base 12 of the framework while the support arms 78 are advantageously attached to a lateral frame member 80. Such attachment may either be permanent or removable, as previously discussed with respect to the leg exercise machine. A boom 82 is attached to and extends outwardly from one of the top frame members 16 of the framework 10. Pivotally attached to the end of the boom is the upper end of a pivoting arm 84, on the other (lower) end of which is mounted a handlebar 86. A fixed bench press machine pulley 88 depends from the underside of a horizontal frame member 90 supported between two of the vertical framework supports 14. A chain 92 depends from the lower end of the pivoting arm 84.

When it is desired to use the bench press machine, the central pulley 18 is pivoted, as previously described, and the rope or cable 26 is passed through the bench press machine pulley 88 so that the "S"-hook 40 may be attached to the chain 92. Thus, a person seated on the stool 72 may, by pushing outwardly against the handlebar 86 and pivoting the pivot arm 84, lift the weight stack 30 with the rope or cable 26 and the pulleys 18 and 88.

Figure 2:
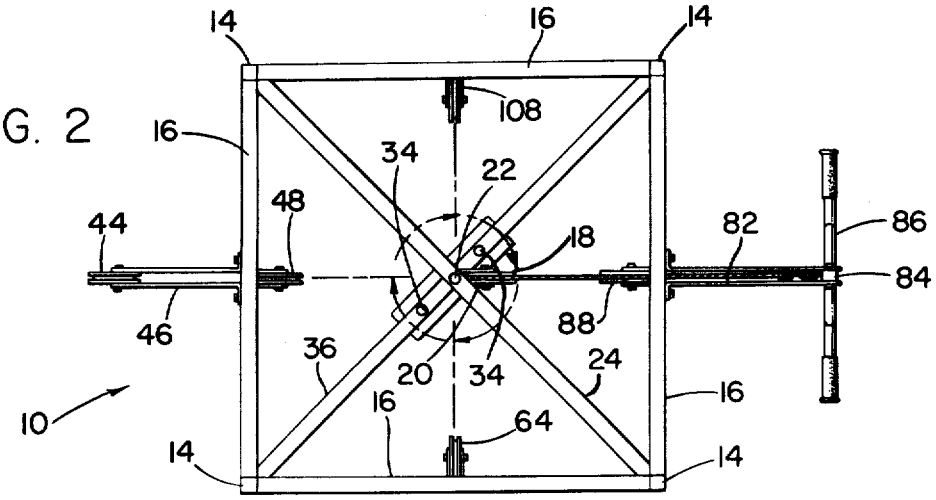
FIG. 2 is a top plan view showing the apparatus of the present invention without the associated exercise machines.

Still another machine which can be used in conjunction with the present invention is an adjustable inclined bench exerciser 100 (sometimes called a "preacher's bench"), which comprises a padded horizontal support 102 supported on a height-adjustable inclined arm 104, which in turn is attached, either removably or permanently, to the base 12 of the framework 10 by means of a triangular support 106. The arm 104 includes means (not shown) for adjusting the angle of inclination. Attached to the inside of the base 12 of the framework 10 adjacent the bench exerciser support 106 is a fixed bench exerciser pulley 108 (FIG. 2).

In use, the central pulley 18 is pivoted, in the manner previously described, so that the rope or cable 26 may be passed through the bench exerciser pulley 108 to engage a separate handlebar (not shown) by means of the "S"-hook 40. Thus, the user may support his body on the padded support 102 while pulling on the handlebar to lift the weight stack 30 by means of the rope or cable 26 acting through the pulleys 18 and 108.

It will be appreciated from the foregoing that the framework 10, along with central pulley 18 and its pivoting bracket 20, may be adapted to accommodate a wide variety of exercising machines, not necessarily those described herein. The modifications that would be needed to adapt the structure to accommodate other types of exercising equipment would be within the expertise of those of ordinary skill in the appropriate arts. Moreover, it will be appreciated that the present invention allows the several associated exercising machines to share a single central pulley, rope or cable, and variable weight stack, thus achieving the goals of minimizing the required floor area needed to accommodate the several machines, and simplifying the structure by eliminating the duplication of components, thereby reducing the cost of such exercise equipment.

What is claimed is:

1. Apparatus for the stationing of multiple exercising machines of the type employing a pulley and cable system to lift a weight, said apparatus comprising:

a plurality of attachable exercising machines spaced apart from each other around the periphery of the apparatus;

a structural framework adapted for the attachment of said exercising machines thereto;

means on said framework adapted for the attachment of at least one fixed pulley for each of said machines; and central pulley means pivotally mounted centrally on said framework, said central pulley means pivotable successively from one machine to another for operative connection to each of said fixed pulleys.

2. The apparatus of claim 1, further comprising:

a weight mounted for vertical movement within the space enclosed by said framework;

a cable having a first end attached to said weight and adapted for operative engagement with said central pulley means and with each of said fixed pulleys as selected by the position of said central pulley; and means for removably attaching a second end of said cable to an operative component of each of said machines.

3. The apparatus of claim 1, wherein said framework comprises:

a base;

a plurality of vertical support members supported by said base, and a plurality of horizontal members interconnecting said vertical support members proximate the upper extremities thereof.

4. The apparatus of claim 3, wherein at least one of said horizontal members traverses the vertical axis of said framework.

5. The apparatus of claim 4, wherein said central pulley means is supported in a bracket which depends from said horizontal member which traverses said vertical axis.

6. The apparatus of claim 5, wherein said bracket is pivotally attached to said horizontal member which traverses said vertical axis.

7. The apparatus of claim 4, wherein said central pulley means is pivotally attached to said horizontal member which traverses said vertical axis, so as to pivot about an axis substantially coaxial with said vertical axis.

8. Apparatus for the stationing of multiple exercising machines of the type employing a pulley and cable system to lift a weight, said apparatus comprising:

a plurality of attachable exercising machines spaced apart from each other around the periphery of the apparatus;

a structural framework having at least three sides, each side adapted for the attachment of one of said exercising machines thereto;

means on said framework adapted for the attachment of at least one fixed pulley for each of said machines;

central pulley means, pivotally attached centrally to said framework, said central pulley means being pivotable successively from one machine to another for operative connection to each of said fixed pulley; and a cable operatively engaging said central pulley means and having a first end connected to a movable weight located within the space enclosed by said framework and a second end having means for removable attachment to an operative component of each of said machines;

whereby said cable can be selectively engaged operatively with a selectable one of said fixed pulleys and selectively attached operatively to one of said machines by pivoting of said central pulley means to a selected position.

9. The apparatus of claim 8, wherein said framework comprises:

a base having at least three sides;

a vertical member supported at each corner of said base; and a plurality of horizontal members connecting the upper end of each of said vertical members to at least two adjacent vertical members.

10. The apparatus of claim 9, wherein said framework further comprises:

a horizontal member traversing the vertical axis of said framework.

11. The apparatus of claim 10, wherein said central pulley means is pivotally attached to said vertical axis-traversing horizontal member so as to pivot about an axis substantially coaxial with the vertical axis of said framework.

12. Apparatus for the stationing of multiple exercising machines of the type employing a pulley and cable system to lift a weight, said apparatus comprising:

a plurality of attachable exercising machines spaced apart from each other around the periphery of the apparatus;

a structural framework having at least three sides, each side adapted for the attachment of one of said exercising machines thereto, said framework comprising:

a base having at least three sides;

a vertical member supported at each corner of said base; and a plurality of horizontal members interconnecting the upper ends of said vertical members, at least one of said horizontal members traversing the vertical axis of said framework;

means on said framework adapted for the attachment of at least one fixed pulley for each of said machines;

central pulley means mounted in a bracket which is pivotally attached to said vertical axis-traversing horizontal member so as to depend therefrom, and so as to pivot about a pivot axis substantially coaxial with said vertical axis, said central pulley means being pivotable successively from one machine to another for operative connection to each of said fixed pulleys;

a weight mounted for vertical movement within the space enclosed by said framework;

a cable adapted for operative engagement with said central pulley means and with each of said fixed pulleys as selected by the position of said central pulley means about said pivot axis, said cable having a first end adapted for operative attachment to said weight; and means for removably attaching a second end of said cable to an operative component of each of said machines.

* * * * *